US011419795B2

(12) United States Patent
Duineveld

(10) Patent No.: US 11,419,795 B2
(45) Date of Patent: Aug. 23, 2022

(54) SEPARATION COMPONENT FOR A FEEDING BOTTLE DEVICE

(71) Applicant: KONINKLIJKE PHILIPS N.V., Eindhoven (NL)

(72) Inventor: Paulus Cornelis Duineveld, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 22 days.

(21) Appl. No.: 16/979,547

(22) PCT Filed: Mar. 4, 2019

(86) PCT No.: PCT/EP2019/055235
§ 371 (c)(1),
(2) Date: Sep. 10, 2020

(87) PCT Pub. No.: WO2019/174943
PCT Pub. Date: Sep. 19, 2019

(65) Prior Publication Data

US 2021/0000693 A1 Jan. 7, 2021

(30) Foreign Application Priority Data

Mar. 15, 2018 (EP) ..... 18161914

(51) Int. Cl.
*A61J 11/00* (2006.01)
*A61J 9/00* (2006.01)

(52) U.S. Cl.
CPC ..... *A61J 11/0015* (2013.01); *A61J 9/00* (2013.01)

(58) Field of Classification Search
CPC ..... A61J 9/00; A61J 11/0015; A61J 11/001; A61J 11/002
See application file for complete search history.

(56) References Cited

U.S. PATENT DOCUMENTS 5,573,507 A 11/1996 Moser
6,343,704 B1 * 2/2002 Prentiss ..... A61J 11/00 215/11.1

(Continued)

FOREIGN PATENT DOCUMENTS

EP 0647442 4/1995
GB 2015350 9/1979

(Continued)

OTHER PUBLICATIONS

International Search Report and Written Opinion dated Mar. 22, 2019 for International Application No. PCT/EP2019/055235 Filed Mar. 4, 2019.

(Continued)

*Primary Examiner* — Andrew T Kirsch

(57) ABSTRACT

The present invention relates to a separation component (10) for a feeding bottle device (1) and a corresponding feeding bottle device (1). The separation component (10) provides a separation between a container space (2) of the baby bottle device (1) and a feeding space (3) for providing liquid to an infant, the separation component (10) comprising a hole wall portion (30) surrounding a hole (32) through the separation component (10) for allowing a passage of fluid from the container space (2) to the feeding space (3) therethrough, wherein the hole wall portion (30) is formed such that, when a pressure of the feeding space (3) side is lower than a pressure of the container space (2) side, a minimum cross-sectional area of the hole (32) is reduced with increased pressure difference between feeding space (3) and container space (2). A decreased risk of overfeeding an infant is achieved.

19 Claims, 5 Drawing Sheets

(56) References Cited

U.S. PATENT DOCUMENTS

| | | | | |
|---|---|---|---|---|
| 2007/0102388 | A1 | 5/2007 | Lewis | |
| 2014/0124469 | A1 | 5/2014 | Richard | |
| 2015/0060386 | A1 | 3/2015 | Palmer | |
| 2016/0310367 | A1 | 10/2016 | Lin | |
| 2018/0021222 | A1* | 1/2018 | Quackenbush | A61J 11/045 215/11.4 |

FOREIGN PATENT DOCUMENTS

| | | |
|---|---|---|
| GB | 2199310 | 7/1988 |
| GB | 2226014 | 6/1990 |

OTHER PUBLICATIONS

Mizuno, et al: "Changes in Sucking Performance from Nonnutritive Sucking to Nutritive Sucking during Breast- and Bottle-Feeding", Pediatric Research, vol. 59, pp. 728-731, 2006.

Lau, et al:". Coordination of suck-swallow and swallow respiration in preterm infants", Acta Paediatr. Vo.92, pp. 721-727, 2003.

Singhal, et al: "Early origins of cardiovascular disease: is there a unifying hypothesis?", The Lancet 363, 1642-1645, 2004.

* cited by examiner

SEPARATION COMPONENT FOR A FEEDING BOTTLE DEVICE

CROSS REFERENCE TO RELATED APPLICATIONS

This application is the U.S. National Phase application under 35 U.S.C. §371 of International Application No. PCT/EP2019/055235 filed Mar. 4, 2019, which claims the benefit of European Patent Application Number 18161914.9 filed Mar. 15, 2018. These applications are hereby incorporated by reference herein.

FIELD OF THE INVENTION

The present invention relates to a separation component for a feeding bottle device and a feeding bottle device comprising the separation component. The separation component is in many embodiments formed as a teat component, while also other separation components such as separate rings between teat component and container component are contemplated. The invention finds particular application for feeding bottles for feeding an infant, while also other applications are feasible.

BACKGROUND OF THE INVENTION

Apart from breast feeding, feeding bottles comprising teat components are well-known solutions for feeding an infant. Known teat components have a single or multiple small teat holes or openings which regulate milk flow from the bottle to the infant. However, when the suction pressure applied by the infant is too high, the flow rate can become too high and the risk of overfeeding of the infant occurs. The reason is that a time delay between the signals being generated in the infant's stomach and the same signals reaching the brain is too high for the infant to efficiently reduce the flow rate and therefore also to limit the final consumed milk volume before overfeeding.

GB 2 015 350 A discloses a baby's feeding bottle teat which has the delivery opening in the form of a slit in a non-convex (e.g. planar or concave) surface at the end of the teat. This allows a delivery rate which, in the minimum flow position, is practically independent of the baby's sucking effort but which in the full flow position is subject to a clearly defined increase or increasing suction effort. Markings are provided on the teat to allow regulation of the flow rate by judgement of the orientation of the slit with respect to the lips.

SUMMARY OF THE INVENTION

It can therefore be regarded an object of the present invention to provide an improved teat component and an improved feeding bottle device which provide a decreased risk of overfeeding an infant.

According to a first aspect, a separation component for a feeding bottle device is provided. The separation component provides a separation between a container space of the baby bottle device and a feeding space for providing liquid to an infant. The separation component comprises a hole wall portion surrounding a hole through the separation component for allowing a passage of fluid from the container space to the feeding space therethrough. The hole wall portion is formed such that, when a pressure of the feeding space side is lower than a pressure of the container space side, a minimum cross-sectional area of the hole is reduced with increased pressure difference between feeding space and container space. The hole has a first dimension and a second dimension perpendicular to the first dimension, the first dimension being at most two times the second dimension.

Since the minimum cross-sectional area of the hole is reduced with increased pressure difference, a resulting flow rate passing the separation component and out of the feeding bottle device can be made close to constant, i.e. dependency of the flow rate on the suction pressure applied by the infant is reduced. Thus, independently from the suction pressure applied by the infant, the flow rate can preferably be made substantially constant and thus the risk of overfeeding the infant is significantly reduced.

Further, since the first dimension is at most two times the second dimension, the hole is preferentially formed in a sufficiently round or elliptical shape which allows for a stable hole to form. The sufficiently round or elliptical shape allows a controlled change in the cross-sectional area of the hole.

Preferentially, the first dimension is at most 1.8 times, more preferably at most 1.5 times and in particular at most 1.3 times the second dimension. With less differences between both dimensions, the hole can be formed with increased stability.

To this end, the hole wall portion preferentially deforms or deflects in response to the applied pressure, wherein the geometry of the hole wall portion results in a reduction of the cross-sectional area of the hole due to the deformation or deflection. A shape and form of the hole wall portion is not limited to a particular shape and form, as long as the geometric result of the deformation or deflection comprises a reduction in the cross-sectional area of the hole.

The separation component itself can be formed as a teat component, i.e. the component which is designed to be latched on and suckled by the infant, wherein the hole formed in the separation component thus can correspond to a teat hole of the teat component. In other embodiments, the separation component can also be formed as a separate component in between a teat component and a container component, for example a partitioning component such as a partitioning ring for partitioning a teat volume from a container volume.

Accordingly, the feeding space can directly be the space outside the feeding bottle device in case the separation component is formed as the teat component itself, or the feeding space can, in case the separation component is formed as a separate partition component, be separated from the infant through the teat. In all cases, liquid is fed to the infant from the feeding space, which is separated from the container space by the separation component and can, for instance, pass the separation component via the hole.

The pressure of the feeding space side is preferentially lower than the pressure of the container space side due to the sucking of the infant. A higher pressure difference accordingly corresponds to a stronger sucking of the infant. While the infant is preferably a human infant, the application can also be employed to feeding bottles for feeding animal infants, preferably mammalian infants.

In a preferred embodiment, the hole wall portion is inclined with respect to the surrounding portion of the separation component, wherein the inclination is oriented towards the container space.

Preferably, the pressure difference will result in a force acting onto the separation component which results in a deflection of at least the hole wall portion in the direction of the feeding space. Since the hole wall portion is inclined towards the container space, an end portion thereof will advantageously become closer together upon deflection in the direction of the feeding space as a result of the pressure difference, thus partly occluding the hole and effectively reducing the cross-sectional area.

In a preferred embodiment, the separation component comprises a thinned portion surrounding the hole wall portion.

The thinned portion surrounding the hole wall portion facilitates a bending of the hole wall portion in the direction of the feeding space and thus the reduction of the cross-sectional area of the hole. Preferentially, the separation component has a substantially constant thickness over the entire surface thereof, while only the thinned portion and optionally additionally the hole wall portion have a reduced thickness compared thereto. Of course, also other thickness variations over the separation component, including for attachment purposes and the like, are contemplated.

In a preferred embodiment, the hole wall portion defines a tapered shape of the hole.

The tapered shape of the hole allows a simple geometrical arrangement for achieving the reduction in cross-sectional area with increased pressure difference. A tapered shape of the hole is generally to be understood as the cross-sectional area of the hole varying along the hole in a neutral or relaxed state of the separation component, i.e. the state in which no pressure difference due to a sucking infant is applied. The hole preferentially shows a conical shape, i.e. the position of minimum cross-sectional area being at either end of the hole, or a shape of a dual cone, i.e. the position of minimum cross-sectional area being at some position between both ends of the hole. In other embodiments, also cylindrical or other shapes of the hole in the neutral or relaxed state are contemplated.

In a preferred embodiment, the hole wall portion comprises a side wall and a bottom plate portion in extension of the side wall, the bottom plate portion defining the hole therein and having a thickness smaller than the thickness of the side wall.

More illustrative, the side wall can be identified as forming an indentation in the separation component with the hole being formed on the bottom plate portion forming the bottom of the indentation. The bottom plate portion thus is preferentially inclined with respect to the side wall such that an applied suction pressure results in a pivot motion of the bottom plate with respect to the side wall about the link between bottom plate portion and side wall. The advantageous reduction of hole diameter can thus be realized through the motion of the bottom plate portion.

Preferentially, the side wall is a cylindrical or a tapered side wall thus forming a cylindrical or tapered indentation.

In a preferred embodiment, the bottom plate portion is curved away from the feeding space, preferably circularly curved.

The curved shape will result in a reduced diameter of the hole formed in the bottom plate portion upon the application of suction pressure from the feeding space side. Preferentially a radius of curvature of the bottom plate portion is smaller than 10 mm.

In a preferred embodiment, the bottom plate portion shows a non-uniform thickness, preferably a reduced thickness in proximity of the hole. A non-uniform thickness of the bottom plate portion facilitates manufacturing, for instance using a laser or by injection moulding.

In a preferred embodiment, the minimum cross-sectional area of the hole is defined as the minimum value of the cross-sectional area normal to a flow direction of fluid through the hole. Preferably, a flow direction along the hole is determined and the hole cross-section normal to and along this flow direction is evaluated. The position along the flow direction through the hole, at which the thus determined cross-sectional area becomes the smallest, is considered the minimum cross-sectional area of the hole.

In a preferred embodiment, a wall thickness of the hole wall portion is within the same order of magnitude of an initial opening of the hole.

A wall thickness of the hole wall portion is defined as an extension of the material normal to the surface of the hole, i.e. also normal to the surface of the hole wall portion, preferably in the region of minimum cross-sectional area. The wall thickness of the hole wall portion can be constant over the entire hole wall portion, or differ along the extension of the hole.

An initial opening of the hole is defined as the neutral or relaxed state, i.e. the state in which no pressure difference is applied. Accordingly, the initial opening corresponds to a smallest extension in diameter, which presents the limiting factor to flow through the hole. Since the wall thickness is within the same order of magnitude of the initial opening, a sufficiently large flow of fluid to the infant is insured, while at the same time the typical pressure differences of sucking babies are sufficient to result in a substantial reduction of cross-sectional area. Compared to other known valves, for instance air inert valves, known to be used in connection with feeding bottles, the initial opening of the hole is much larger. More specifically, despite being oriented in the opposite direction, air inlet valves for instance have a substantially non-existent and thus much smaller initial opening.

In a preferred embodiment, the wall thickness is in the range of 0.1 mm to 2 mm, preferably in the range of 0.1 mm to 1.5 mm. A wall thickness within this range has shown to provide the desired advantageous characteristics for the response to applied pressure for a wide range of materials generally used in the field.

In a preferred embodiment, the height of the hole wall portion, which is defined as the extension of the hole wall portion in direction of the hole relative to the surrounding portion of the separation component, is in the range of 0.01 mm to 10 mm, more preferably in the range of 0.05 mm to 2 mm.

The height of the hole wall portion thus corresponds to an extension normal to the surrounding portion of the separation component. Expressed differently, the height can be identified as the extension of the hole wall portion to the inside of the container volume with respect to the surrounding portion of the separation component. With a bending of the hole wall portion towards the feeding space, particularly the part of the hole wall portion extending to the inside of the container volume gets closer together. Advantageously, by providing the extension in the preferred range, any deflection of the hole wall portion will result in an adequate narrowing of the minimum cross-sectional area of the hole.

In a preferred embodiment, the hole wall portion forms a duckbill type valve. The duckbill type valve according to this embodiment is oriented to the inside of the container volume, i.e. narrows its opening with an increased pressure difference between container space and feeding space. Nevertheless, as already detailed above, a significant initial opening of the duckbill type valve is preferred in order to ensure the desired fluid flow to the feeding space be possible.

In a preferred embodiment, the extensions of the hole wall portion are configured such that a response time of the hole wall portion to a pressure variation does not exceed 0.1 seconds, the response is sufficiently quick for pressure A response time of the hole wall portion is defined as the time which passes from a pressure change to the adaptation of the hole wall portion to the changed pressure. Since the response time does not exceed 0.1 seconds, the response is sufficiently quick for pressure variations experienced with infants. Generally, it is known that larger extensions result in slower response times. Expressed differently, by designing the extensions of the hole wall portions sufficiently small, the limit for the response time can be met easily.

In a preferred embodiment, the separation component comprises at least one of a silicone material and a thermoplastic elastomer (TPE). These materials are of course just examples, and in principle any soft material can be used.

In a preferred embodiment, the separation component is manufactured using 2K injection molding, wherein an elastic modulus of the material in the region of the hole wall portion is different from, preferentially corresponding to a lower Shore hardness than, an elastic modulus of the material in the region outside the region of the hole wall portion.

Thereby, it can be ensured that the deflection or deformation of the separation component induced by the pressure difference occurs at the region of the hole wall portion and thus with the advantageous effect on the cross-sectional area of the hole.

In a preferred embodiment, an elastic modulus of at least part of the separation component, preferably at least the hole wall portion, is in the range of 10 to 80 Shore A, more preferably in the range of 20 to 50 Shore A.

A too high Shore hardness will impede the desired deflection under the application of the typically experienced pressure differences, while a too small Shore hardness will result in an occlusion of the opening and thus impede fluid flow. With the Shore hardness falling within the preferred range, the response to the pressure difference will be further improved.

In a preferred embodiment, the hole has an elliptic, preferably circular, cross section.

The elliptic, preferably circular, cross section allows for an advantageous fluid flow through the hole. Preferentially, the elliptic, preferably circular, cross section is at least formed at the point of minimum cross-sectional area, while it is further preferred that the shape be elliptical or circular along the entire hole. However, also other cross-sectional shapes can of course likewise be implemented by the skilled person.

In a preferred embodiment, a minimum diameter of the hole is in the range of 0.1 mm to 2 mm, more preferably in the range of 0.2 mm to 0.4 mm.

The minimum diameter is defined as the smallest connection of two opposite edge points of the cross-sectional area. Preferentially, the minimum diameter of the hole is within the preferred range at least at the point of minimum cross-sectional area in the neutral state, while in a further preferred embodiment the minimum diameter remains within the preferred range throughout operation.

In a preferred embodiment, the hole is formed by a laser or by injection molding.

It is known that teat holes in readily available teat components are directly formed during the injection molding process. This can directly be applied to the present invention, i.e. the hole of the separation component showing the advantageous pressure response can likewise directly be formed through injection molding by appropriately providing the injection molding tool. Additionally or alternatively, laser processing can be used on the separation component as a subsequent step.

In a preferred embodiment, the separation component comprises a plurality of holes being surrounded by a hole wall portion, respectively. The number of holes is preferably between 1 and 20 and more preferably in the range of 1 to 4. A plurality of holes provides a plurality of possible fluid passages and thus a certain desired fluid flow can be ensured even if one or more of the holes are clocked, for instance. Additionally or alternatively, the additional holes can all show the negative cross-sectional area variation with increasing pressure difference, one, more or all of the additional holes can show a neutral pressure dependency, i.e. not vary with pressure, or even varies positively in the smallest cross-sectional area with suction pressure.

In a preferred embodiment, the separation component is formed as a teat component, the teat component defining a teat volume therein and comprising an attachment portion for attachment with a container component of the baby bottle device and a suckling portion for being inserted into a mouth of an infant, wherein the hole wall portion surrounding the hole is arranged at the suckling portion.

In this embodiment, the advantageous pressure response of the separation component according to the invention can directly replace the presently available teat components and the teat hole thereof. More specifically, the teat component according to this embodiment can be used as a replacement component of a teat component of any kind of baby bottle devices, wherein the advantageous layout of the teat hole allows a reduction of the risk of overfeeding of the infant.

According to a second aspect, a feeding bottle device for feeding an infant is provided. The feeding bottle device comprises a separation component according to the first aspect of the invention.

It shall be understood that the separation component of claim 1 and the feeding bottle device of claim 15, have similar and/or identical preferred embodiments, in particular, as defined in the dependent claims.

It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
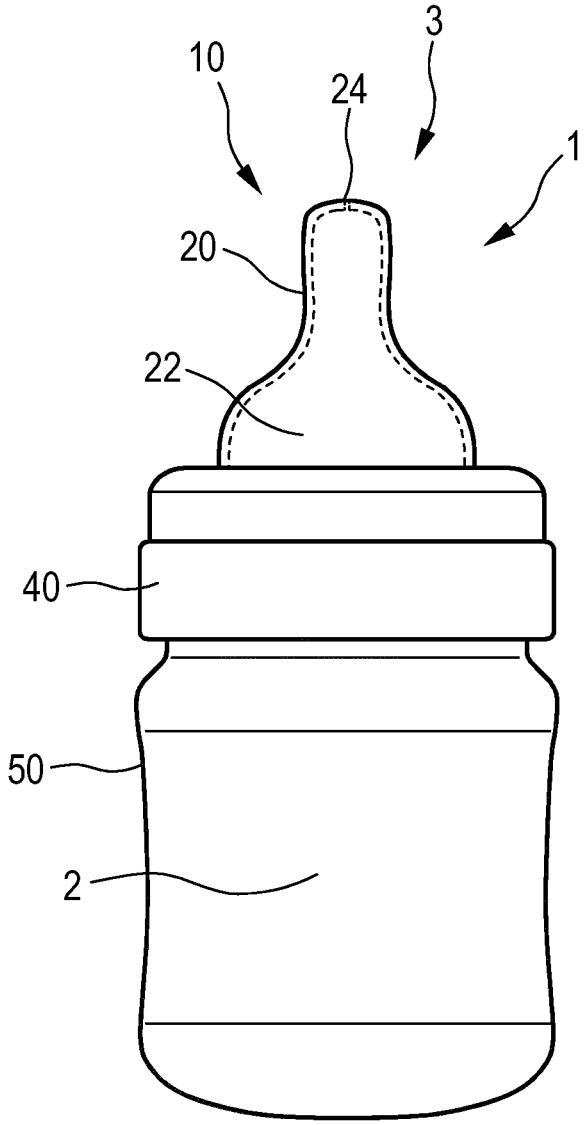
FIG. 1 schematically and exemplarily illustrates a feeding bottle device.

FIG. 1 schematically and exemplarily illustrates a feeding bottle device 1 comprising a teat component 20, a container component 50 and an attachment component 40, by means of which teat component 20 is attached to container component 50 when the feeding bottle device 1 is used for feeding an infant.

In this example, liquid contained within a container space 2 within container component 50 can reach a feeding space 3 outside of teat component 20 through a teat hole 24 provided at teat component 20.

In this example, teat component 20 thus forms a separation component 10 which separates container space 2 from feeding space 3. It should, however, be contemplated that separation component 10 can likewise be implemented as, for instance, a separate ring or separate component, for instance within attachment component 40. Thus, while in the subsequent description the example of separation component 10 being implemented as teat component 20 will be considered, it should be emphasized that also other implementations of separation component 10 are feasible. Accordingly, in case separation component 10 is integrated in, for instance, a ring within attachment component 40, a teat space 22 within teat component 20 is separated by such separation component 10 from container space 2. Consequently, in such examples, teat space 22 would be part of feeding space 3 since it resides on the side of separation component 10 opposite to container space 2.

It is known to regulate milk flow through one or more teat holes 24 of order 0.3 mm. Teat holes 24 are preferably formed by a laser or by injection molding, wherein injection molding results in hole diameters with a reduced standard deviation in the diameter compared to those formed by a laser.

Compared to feeding bottle devices 1 as known in the art, teat hole 24 according to the example in accordance with the present invention does not show the behavior that a cross-sectional area of teat hole 24 remains constant or increases in area with increasing suction pressure. Instead, teat hole 24 according to the invention reduces in cross-sectional area with increasing suction pressure, such that the flow rate of liquid through teat hole 24 is limited even if the infant applies a very high suction pressure. Thus, the problem of known feeding bottle devices 1 is avoided that a flow rate could be too high for an infant with the result that the infant could overfeed as the time delay between the signals of the stomach to the brain is too slow for the baby to reduce its flow rate.

Negative effects of overfeeding include a short term disadvantage like reflux etc. and a potential negative effect on the health at later life due to the infant growing too fast, i.e. crossing growth curves, as has been shown in, for instance, A. Singhal and A. Lucas Early origins of cardiovascular disease: is there a unifying hypothesis? The Lancet 363, 1642-1645, 2004.

The main reason for this effect resides in the basic physics of the flow rate of a teat hole 24. A large portion of the flow rate is governed by the suction pressure that babies apply, which is subject to a huge variation and thus results in a large variation of flow rates experienced by babies.

For a teat hole 24 or likewise a similar hole in a different separation component 10 the standard formula for the relation of a flow rate Q and pressure $\Delta p_{teat}$ is given by $$Q(t) = A_{teat}\sqrt{\frac{\Delta p_{teat}(t)}{\rho k}} \quad \text{(eq 1)}$$

Here $A_{teat}$ is the area of teat hole 24 or comparable hole, $\Delta p_{teat}$ is the pressure drop over teat hole 24 between container space 2 and feeding space 3, p the density of the liquid and k a resistance constant, which is of the order of 1 and depends on the details of the hole.

The pressure drop over teat hole 24 can be expressed as $\Delta p_{teat}=p_{bottle}-p_{baby}(t)$. The pressure in the bottle depends on the crack pressure of the bottle, but this pressure in the bottle is very close to atmosphere, around 15 mbar below atmosphere, which is small compared to the suction pressure the baby applies. So approximately we have $\Delta p_{teat}\approx\Delta p_{baby}$.

In order to have a rather constant flow rate the area of the teat hole should scale ideally according to:

$$A_{teat} \propto \sqrt{\frac{1}{\Delta p_{teat}}} \quad \text{(eq 2)}$$

More generically, a relation fulfilling $$A_{teat} \propto (\Delta p_{teat})^{-\alpha} \quad \text{(eq 3)}$$

with $\alpha$ a positive number, will already show the beneficial limitation of flow rate with increased pressure drop. Even more generic, a response function where the area of the teat hole 24 changes according to $$A_{teat} \propto f(\Delta p_{teat}) \quad \text{(eq 4)}$$

with $f(\Delta p_{teat})$ being a function that has at least in some part of the $\Delta p$ domain a negative derivative with $\Delta p$, hence $A_{teat}$ is dropping with increasing $\Delta p_{teat}$, or also $\Delta p_{baby}$, will yield the desired limiting result on the flow rate.

The suction pressure that a baby applies with its tongue is varying approximately sinusoidal with a frequency that is around 1 Hz.

In this example, a general suction pressure can be given as a function of time by $$\Delta p_{suction}(t)=\tfrac{1}{2}\Delta p_{max}(1+\cos \omega t) \quad \text{(eq 5)}$$

Based thereon, the average flow rate thus follows from inserting (5) in (1) and integrating over time $$Q_{average} = A_{teat}\sqrt{\frac{\Delta p_{max}}{\rho k}}\,\frac{\omega}{\pi}\int_0^{\frac{\pi}{\omega}}\sqrt{\frac{1}{2}(1+\cos\omega t)}\,dt \quad \text{(eq 6)}$$

This results in:

$$Q_{average} = A_{teat}\frac{2}{\pi}\sqrt{\frac{\Delta p_{max}}{\rho k}} \quad \text{(eq 7)}$$

It can be seen that also for a varying suction pressure, e.g. a suction pressure which varies sinosoidally, an increase in flow rate with increasing maximum suction pressure will be observed.

Literature data on suction pressure variation in young babies give a huge spread in reported determined values for maximum suction pressure generated by babies. In one study from K. Mizuno et al., Pediatric Research, vol 59, pp 728-731, 2006, max suction pressures at a bottle are reported of 122 mbar with a standard deviation of 35 mbar, Lau et al. Acta Paediatr. Vol92, pp 721-727, 2003 reports 176 mbar±46 mbar, and a study carried out by the applicant reports 280 mbar±70 mbar. While all these studies contain only a small number of babies, of the order of 10, and thus contain large uncertainties in the mean as well as the standard deviation, the results indicate that the range in suction pressure that a baby exerts could easily be from 80 to 320 mbar maximum suction pressure. This results, based on equation 7, in a factor of 2 difference in flow rate, which is very significant and is preferably reduced.

It is thus a main element of the present invention to provide teat hole 24 or likewise a corresponding hole of separation component 10 that reacts at least in part negatively on the suction pressure applied by the infant. Accordingly, the variation in flow rate that usually occurs due to the variation of the suction of the infant is counteracted. The particular arrangement and geometrical design of teat hole 24 and the surrounding portion of teat component 20, e.g. implemented as separation component 10, is not limited to a particular layout.

A principle implementation of the solution according to the invention is based on a valve integrated in the material of separation component 10 is illustrated in four different examples in FIGS. 2A to 2D. In all examples, the pressure difference over the valve is increasing, i.e. the pressure in the mouth decreases, the cross-sectional area of the hole for the flow of liquid is decreased, in accordance with the principles of the invention.

Figure 2A:
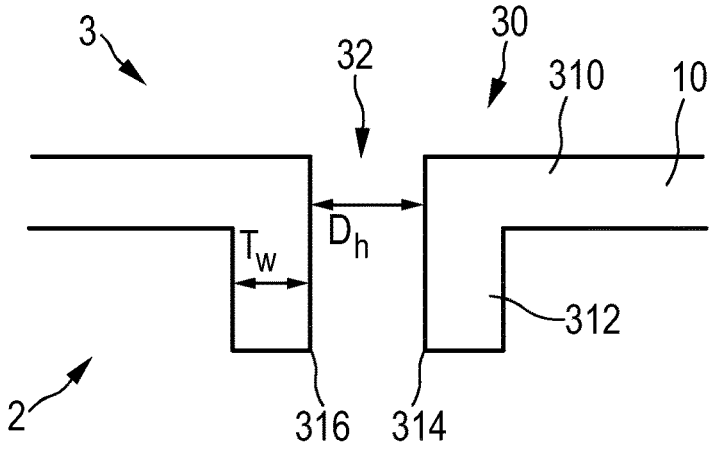
FIG. 2A schematically and exemplarily illustrates a separation component according to a first example, FIG. 2B schematically and exemplarily illustrates a separation component according to a second example, FIG. 2C schematically and exemplarily illustrates a separation component according to a third example, FIG. 2D schematically and exemplarily illustrates a separation component according to a fourth example, FIG. 3 schematically and exemplarily illustrates a pressure over flow diagram, FIG. 4A schematically and exemplarily illustrates a separation component according to a fifth example, FIG. 4B schematically and exemplarily illustrates the separation component of the fifth example in further detail, FIG. 5 schematically and exemplarily illustrates a top view on the separation component of the fifth example, and FIG. 6 schematically and exemplarily illustrates the separation component of the fifth example in further detail.

FIG. 2A schematically and exemplarily illustrates a first example of separation component 10 comprising a hole 32 being surrounded by a hole wall portion 30. As mentioned above, hole 32 can correspond to teat hole 24 in case separation component 10 is implemented as part of teat component 20, while also other, separate implementations of separation component 10 are feasible.

In the example of FIG. 2A, hole wall portion 30 comprises a first portion 310 which is substantially identical to the adjacent portion of separation component 10 and an inclined portion 312. In this example, inclined portion 312 is substantially perpendicular to first portion 310 and thus defines a substantially cylindrical shape of hole 32. In this example, hole wall portion 30 thus comprises straight walls. Two opposite endpoints 314 and 316 get closer to each other when a negative pressure on feeding space 3 side compared to container space 2 side, i.e. the pressure difference or drop over hole 32, increases.

Figure 2B:
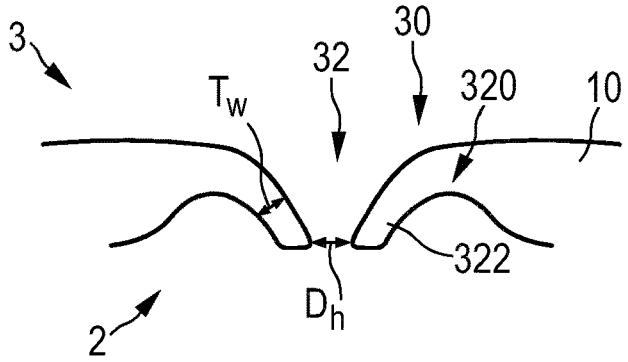
Figure 2C:
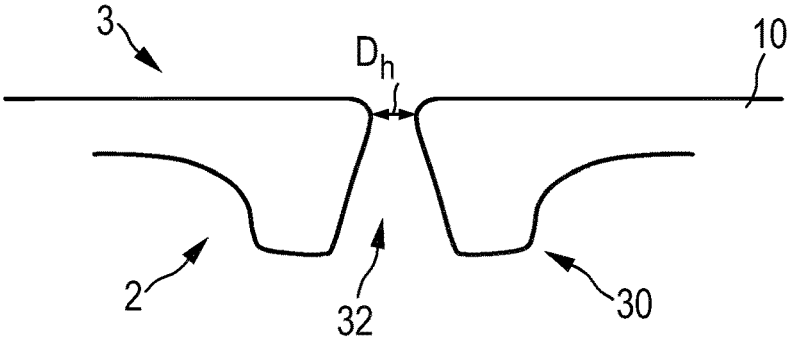
Figure 2D:
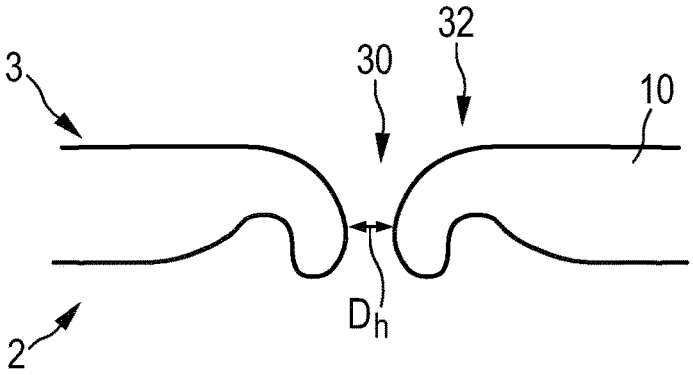

In contrast to the straight walls of the example of FIG. 2A, in the examples of FIGS. 2B to 2D the hole wall portions 30 show tapered walls, respectively.

In FIG. 2B, hole wall portion 30 comprises a thinned portion 320 adjacent a tapered wall portion 322. The shape of hole 32 is tapered such that its diameter or cross-sectional area reduces from the feeding space 3 side to the container space 2 side. Since the narrowest cross-sectional area is at the position of the thinnest wall thickness, i.e. at an end portion of tapered wall portion 322, the example of FIG. 2B will show a large change in cross-sectional area with change in pressure.

The examples of FIGS. 2C and 2D illustrate a different tapering of hole 32, namely a hole diameter $D_h$ increasing from the feeding space 3 side to the container space 2 side in FIG. 2C and the minimum diameter being in the center of the hole 32 in the example of FIG. 2D.

All examples have in common that the area of hole 32 responds negatively on the suction pressure. Hole 32 can be designed in such a way that it matches with the average flow rate generated during breast feeding by infants, for instance.

The wall thickness $T_w$ of hole wall portion 30 is preferentially in the order of 0.1 to 1 mm and thus rather thin.

The separation component 10 according to the invention implements a principle comparable to air vent valves known in the context of feeding bottle devices 1, while the implementational details differ significantly. Most prominent, air vent vales open with a higher pressure difference, while the opening and thus the flow cross section is reduced with respect to the present invention. Further, typical pressure differences discussed in the present invention, i.e. response pressures for hole 32, are in the order of 150 to 200 mbar, while pressure differences of air vent valves do not exceed 15 to 20 mbar.

The diameter $D_h$ of hole 32 is preferentially in the order of 0.1-2 mm and more preferably in the range of 0.2-0.4 mm. The shape of the hole at minimum cross sectional area is preferably circular but could also be of other shapes, like elliptical.

The height of the hole wall portion 30 above the surrounding region of separation component 10 is in the range of 0.01 to 10 mm and more preferably in the range of 0.05 to 2 mm.

The elastic modulus of the material of separation component 10, more particularly of hole wall portion 30, is in the range of 10 to 80 Shore A and more preferably in the range of 20-50 Shore A.

The design of hole wall portion 30 implementing the valve is preferably such that is can respond fast, i.e. preferably faster than 0.1 seconds and therefore faster than the suction pressure variation frequency, which is ≈1 Hz. Accordingly, the dimensions of hole wall portion 30 are not too large.

Preferably, a 2K moulding of the separation component 10, for instance implemented as teat component 20, can be made where all or significant parts of material of the separation component 10 outside the region surrounding hole 32, i.e. substantially outside hole wall portion 30, are made of different and preferably larger Shore hardness than the material of which hole wall portion 30 is made.

It is also preferred to combine several holes 32 in a single separation component 10, wherein the number preferentially varies between 1 and 20 and more preferably in the range of 1 to 4.

It is also possible to combine the hole 32 according to the invention with one or more holes that does not vary with pressure, i.e. comparable to known teat holes, or that vary positively in the smallest cross sectional area with suction pressure.

Further, as discussed above, while a preferred location for hole 32 and separation component 10 is teat hole 24 and the teat component 20, respectively, it is also possible to change the position of hole 32 and separation component 10 to a different position, for instance to a separate disk in attachment component 40.

For the material of separation component 10, e.g. teat component 20, any soft material can be used such as silicone or TPE.

It should be noted that in principle it is also possible to make a hole 30 with such a long length that equation 1 is not applicable anymore and also the resistance of the pipe flow needs to be introduced. Still in this case, the general principle of teats described above with respect to hole 32 will remain.

Figure 3:
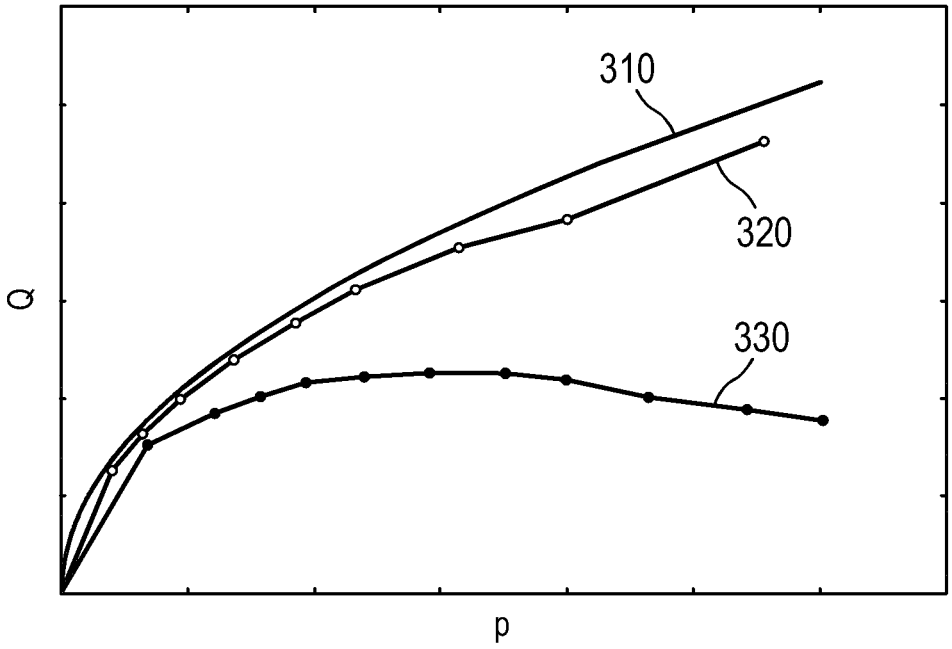

FIG. 3 schematically and exemplarily illustrates flow rate Q on a vertical axis over an applied pressure difference on a horizontal axis for different hole or valve arrangements. A reference line 310 describes the behaviour for a constant diameter hole. With increasing pressure difference, the flow constantly increases.

Lines 320 and 330 describe the behaviour of fluid flow over pressure difference for a separation component 10 according to the present invention, while a Shore hardness of separation component 10 is higher for the separation component 10 underlying line 320, then it is for line 330. For a stiff material, e.g. line 320, the flow rate scales according to the reference line 310 and is only relatively slightly decreased. For the softer material, the flow rate levels off and even drops in flow rate as illustrated with line 330. Accordingly, by measuring flow rate as a function of pressure difference, it can easily be seen whether separation component 10 fulfils the requirements of the present invention.

In one embodiment, hole 32 can also buckle when the pressure difference or drop exceeds a certain maximum. In this way the flow rate dramatically decreases and hence the infant is not rewarded for this excessive sucking. The infant is thus encouraged to adapt its suction pressure to lower values which in return give a lower flow rate and prevents overfeeding in the long and short term.

FIGS. 4A, 4B, 5 and 6 schematically and exemplarily illustrate different views on a separation component 10 according to a fifth example. The fifth example shown in FIGS. 4A, 4B, 5 and 6 is another solution for achieving a reduction of the hole area with increasing suction pressure.

The separation component 10 according to the fifth example is implemented in the teat component 20, more precisely the teat hole 24 thereof fulfills the function of the hole 32 with reduced area with increasing suction pressure. In this example, hole wall portion 30 and hole 32 correspond to the region of teat hole 24.

Figure 4A:
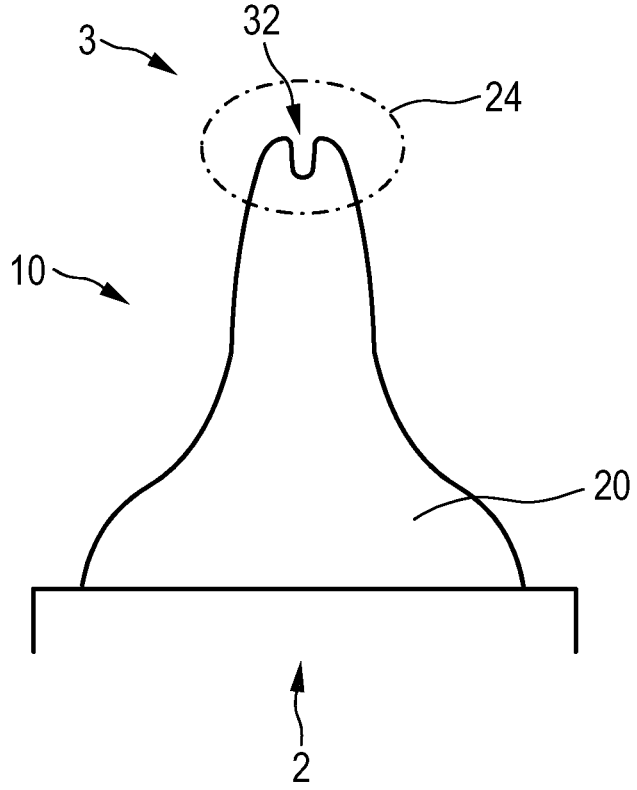
Figure 4B:
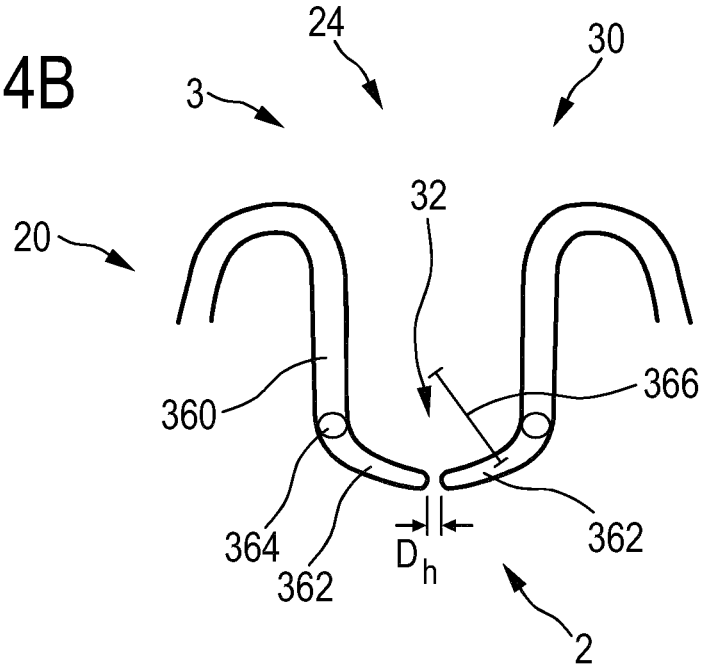
Figure 5:
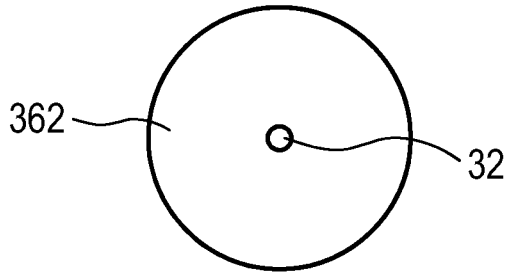
Figure 6:
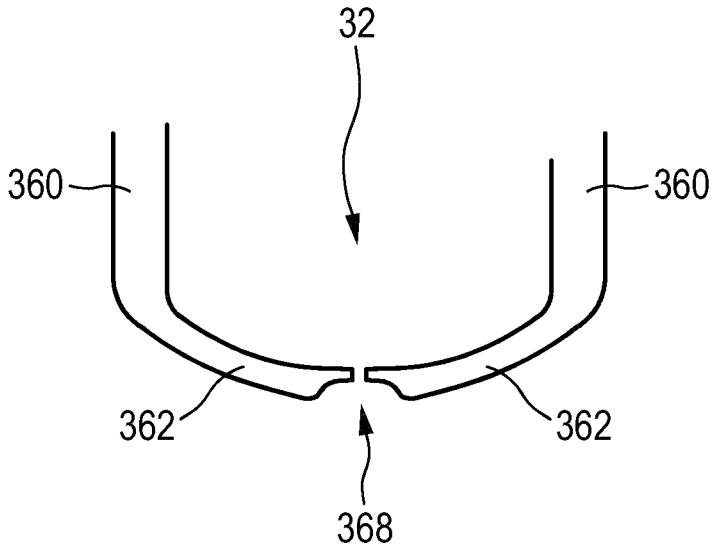

A detailed view of the fifth example is provided in FIG. 4B, a top view is shown in FIG. 5 and a further exemplary detail is shown in FIG. 6.

In this example, hole wall portion 30 comprises an inward indentation into the, for instance, silicon of the teat component 20 and comprises cylindrical side wall portions 360. In other examples, side wall portions 360 can also be tapered inwardly or outwardly and thus not form a precise cylinder therein.

Preferably, cylindrical side wall portions 360 have a wall thickness of 0.1 to 2 mm and a length of 1 to 10 mm. As an extension of cylindrical side walls 360, a base or bottom plate portion 362 is provided. Bottom plate portion 362 reduces the size of the opening of cylindrical side walls 360 so that a hole 32 of the extension $D_h$ can be obtained as desired. Preferably, a diameter $D_h$ is in the range of 0.1 to 1 mm.

Bottom plate portion 362 is provided in a curved, preferably circularly curved, shape, wherein the curve is directed away from feeding space 3. Preferably, a radius 366 of bottom plate portion 362 is smaller than 10 mm in the plane as illustrated in, for instance, FIG. 4B. A diameter of the bottom plate portion 362 is preferably in the range of 0.5 to 10 mm, corresponding to the opening of the lower end of cylindrical side walls 360.

Core of the fifth example is that a thickness of the bottom plate portion 362 is less than a thickness of the cylindrical side walls 360, such that at the transition between cylindrical side walls 360 and bottom plate portion 362, indicated as pivoting point 364, an upwards movement of the bottom plate portion 362, corresponding to a pivot motion about pivoting point 364, occurs when pressure is applied. The larger the suction pressure applied on feeding space 3 side of separation component 10, the larger the upwards movement of bottom plate portion 362 will be. Due to this motion and geometrical constraints, the opening area of hole 32 through which the milk needs to flow is thus reduced.

While in the example of FIGS. 4A, 4B, 5 and 6 a single hole 32 is illustrated, it should be noted that also a plurality of such holes 32 can be provided. The plurality of holes 32 can be arranged at the same bottom plate portion 362 or in the course of a plurality of provided teat holes 24.

FIG. 5 schematically and exemplarily illustrates a top view on bottom plate portion 362 showing hole 32 in the center thereof. Upon the application of such impression, a diameter of hole 32 is reduced with increased pressure difference.

Finally, FIG. 6 schematically and exemplarily illustrates a further modification of the fifth example introduced in FIG. 4A in further detail. Therein, a non-uniformly shaped bottom plate portion 362 is illustrated. More specifically, a thickness of bottom plate portion 362 can be reduced in the region of hole 32, indicated with a region 368, in order to facilitate manufacturing of hole 32 using lasers or molding, for instance. The thickness of the bottom plate portion 362 in region 368 is preferably in the same range as the diameter $D_h$ of hole 32 itself, i.e. also in the range of 0.1 to 1 mm.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit, component or device may fulfill the functions of several items recited in the claims. The mere fact that certain measures are recited in mutually different dependent claims does not indicate that a combination of these measures cannot be used to advantage.

The invention claimed is:

1. A separation component for a baby bottle device, the separation component providing a separation between a container space of the baby bottle device and a feeding space for providing liquid to an infant, the separation component comprising a hole wall portion surrounding a hole through the separation component for allowing a passage of fluid from the container space to the feeding space therethrough, the hole having a minimum cross-sectional area at a first state, wherein the minimum cross-sectional area is reduced at a second state with increasing pressure difference between the feeding space and the container space, wherein the hole wall portion comprises two walls opposite from each other and inclined with regard to a surrounding portion of the separation component, the two walls comprising end portions that are configured to move closer together at the second state when a pressure of the feeding space side is lower than a pressure of the container space side, wherein the hole has a first dimension and a second dimension perpendicular to the first dimension, the first dimension being at most two times the second dimension.

2. The separation component according to claim 1, wherein the inclination of the two walls is oriented toward the container space.

3. The separation component according to claim 1, wherein the separation component comprises a thinned portion surrounding the hole wall portion.

4. The separation component according to claim 1, wherein the hole wall portion comprises a side wall and a bottom plate portion in extension of the side wall, the bottom plate portion defining the hole therein and having a thickness smaller than the thickness of the side wall.

5. The separation component according to claim 4, wherein the bottom plate portion is circularly curved away from the feeding space curved.

6. The separation component according to claim 4, wherein the bottom plate portion shows a non-uniform thickness that is a reduced thickness in proximity of the hole.

7. The separation component according to claim 1, wherein a wall thickness of the hole wall portion is within the same order of magnitude of an initial opening of the hole.

8. The separation component according to claim 7, wherein the wall thickness is in the range of 0.1 mm to 2 mm.

9. The separation component according to claim 1, wherein a height of the hole wall portion, which is defined as the extension of the hole wall portion in direction of the hole relative to the surrounding portion of the separation component, is in the range of 0.01 mm to 10 mm.

10. The separation component according to claim 1, wherein the separation component comprises at least one of a silicone material and a thermoplastic elastomer, wherein the separation component is manufactured using 2K injection molding, wherein an elastic modulus of the material in the region of the hole wall portion is different from an elastic modulus of the material in the region outside the region of the hole wall portion.

11. The separation component according to claim 10, wherein an elastic modulus of at least part of the separation component, preferably at least the hole wall portion, is in the range of 10 to 80 Shore A.

12. The separation component according to claim 1, wherein the hole has an elliptic or circular cross section, wherein a minimum diameter of the hole is in the range of 0.1 mm to 2 mm.

13. The separation component according to claim 1, wherein the separation component is formed as a teat component, the teat component defining a teat volume therein and comprising an attachment portion for attachment with a container component of the baby bottle device and a suckling portion for being inserted into a mouth of an infant, wherein the hole wall portion surrounding the hole is arranged at the suckling portion.

14. A feeding bottle device for feeding an infant, wherein the feeding bottle device comprises a separation component according to claim 1.

15. A baby bottle device comprising a separation component, the separation component providing a separation between a container space of the baby bottle device and a feeding space for providing liquid to an infant, the separation component comprising a hole wall portion surrounding a hole through the separation component for allowing a passage of fluid from the container space to the feeding space therethrough, the hole having a minimum cross-sectional area at a first state, wherein the minimum cross-sectional area is reduced at a second state with increasing pressure difference between the feeding space and the container space, wherein the hole wall portion comprises two walls opposite from each other and inclined with regard to a surrounding portion of the separation component, the two walls comprising end portions that are configured to move closer together at the second state, when a pressure of the feeding space side is lower than a pressure of the container space side, wherein the hole has a first dimension and a second dimension perpendicular to the first dimension, the first dimension being at most two times the second dimension.

16. The separation component according to claim 15, wherein the hole wall portion comprises a side wall and a bottom plate portion in extension of the side wall, the bottom plate portion defining the hole therein and having a thickness smaller than the thickness of the side wall.

17. The separation component according to claim 15, wherein a wall thickness of the hole wall portion is in the range of 0.1 mm to 2 mm.

18. The separation component according to claim 15, wherein a height of the hole wall portion, which is defined as the extension of the hole wall portion in direction of the hole relative to the surrounding portion of the separation component, is in the range of 0.01 mm to 10 mm.

19. The separation component according to claim 15, wherein the hole has an elliptic or circular cross section, wherein a minimum diameter of the hole is in the range of 0.1 mm to 2 mm.

* * * * *